United States Patent [19]

Hamada et al.

[11] Patent Number: 4,818,667

[45] Date of Patent: Apr. 4, 1989

[54] SILVER HALIDE COLOR PHOTOGRAPHIC MATERIAL

[75] Inventors: Fumio Hamada; Hiroshi Shimazaki, both of Tokyo, Japan

[73] Assignee: Konishiroku Photo Industry Co., Ltd., Tokyo, Japan

[21] Appl. No.: 2,200

[22] Filed: Jan. 12, 1987

[30] Foreign Application Priority Data

Jan. 20, 1986 [JP] Japan ..... 61-11757

[51] Int. Cl.[4] ..... G03C 1/46; G03C 7/34

[52] U.S. Cl. ..... 430/502; 430/504; 430/505; 430/496; 430/543; 430/552; 430/553

[58] Field of Search ..... 430/504, 505, 552, 553, 430/543, 496, 502

[56] References Cited

U.S. PATENT DOCUMENTS

| | | | |
|---|---|---|---|
| 4,389,479 | 6/1983 | Bishop et al. | 430/505 |
| 4,434,225 | 2/1984 | Sugita et al. | 430/553 |
| 4,458,012 | 7/1984 | Ito et al. | 430/553 |
| 4,518,683 | 5/1985 | Kato et al. | 430/553 |
| 4,584,264 | 4/1986 | Ohbi et al. | 430/542 |
| 4,707,434 | 11/1987 | Koboshi et al. | 430/393 |

OTHER PUBLICATIONS

Wolfe et al., "Determination of the Modulation . . . ", Journal of the Optical Society of America, 9/68, pp. 1245–1255.

*Primary Examiner*—Paul R. Michl
*Assistant Examiner*—Patrick A. Doody
*Attorney, Agent, or Firm*—Finnegan, Henderson, Farabow, Garrett & Dunner

[57] ABSTRACT

In a silver halide color photographic material which has red-, green- and blue-sensitive silver halide emulsion layers on a support, the improvement wherein the total thickness of the hydrophilic colloid layers is not more than 18 μm on a dry basis and at least one silver halide emulsion layer contains a cyan dye-forming coupler represented by the following general formula (I):

(I)

where $R_1$ is an optionally substituted alkyl, aryl or heterocyclic group; Ar is an optionally substituted aryl group; and X is a group that may be eliminated upon coupling reaction with the oxidized product of a color developing agent.

11 Claims, No Drawings

SILVER HALIDE COLOR PHOTOGRAPHIC MATERIAL

BACKGROUND OF THE INVENTION

1. Field of the Invention

The present invention relates to a silver halide color photographic material. More particularly, the present invention relates to a silver halide color photographic material that employs a thinner coating format to achieve higher image sharpness and which yet produces an effectively recolored cyan dye image while ensuring improved stability under varying processing conditions as well as good storage characteristics.

2. Description of the Prior Art

Modern light-sensitive materials are required to meet the growing demand of the user for higher image quality. On the other hand, active efforts have been made to reduce the size of the format of light-sensitive materials. For these two reasons, a multitude of proposals have been made for making light-sensitive materials capable of producing images of high quality.

The quality of the image produced by a color light-sensitive material is generally evaluated in terms of sharpness, graininess and color reproduction. A particularly high degree of sharpness is required in order to realize the reproduction of fine detail in a light-sensitive material of small format.

The efforts which have been made to provide improved image sharpness are based on two approaches, optical and chemical (i.e., rapid development). In the optical approach, the use of monodispersed silver halide grains has atracted the attention of researchers because they contribute to enhanced transmittance of radiation. Efforts also continue to decrease optical scattering by making emulsion layers as thin as possible. Light is scattered progressively further as it penerates deeper into a multilayer structure, so that the image formed in a silver halide emulsion layer which is closer to the support tends to be less sharp than the images formed on the overlying layers. It is therefore known that a particularly effective way to provide improved image sharpness is to make the emulsion layers thinner by reducing the binder content [see, for example, Journal of the Optical Society of America 58 (9), 1245–1256 (1968) and Photographic Science and Engineering 16 (3), 181–191 (1972)]. The specific means that have been proposed for meeting this need include reduction in the coating weight of gelatin, reduction in the coating weight of coupler, reduction in the amount of a high-boiling point solvent used as a coupler dispersant, and the use of a "polymer coupler". However, none of these methods are desirable for the purpose of attaining improved photographic performance since they increase the graininess and degrade the storage stability and the ability of couplers.

For instance, if the approach selected is simply to reduce the thickness of a gelatin coating in a light-sensitive layer with a high-boiling point organic solvent being used as a coupler solvent, undesirable phenomena such as the agglomeration and disruption of coupler in oil droplets in the coating occur and this causes either the crystallization of the coupler or the "bleeding" of oil droplets on the surface of the light-sensitive material. Because of these disadvantages, the method of simply reducing the coating weight of gelatin has yet to be commercialized.

The reduction in the amount of coupler used generally results in a lowered color density and the development of couplers capable of efficient color formation is strongly desired. In ordinary color light-sensitive materials, the red-sensitive emulsion layer which is situated the closest to the support of the emulsion layers is most susceptible to the effects of development and hence are highly likely to experience a considerable drop in color density as a result of the reduced use of a coupler. The advent of a cyan coupler capable of efficient color formation is therefore desired.

In order to meet the requirement for rapid development, the tendency of modern photographic laboratories to employ higher processing temperatures and shorten the processing period is increasing. However, if an attempt is made to shorten the step of bleaching or bleach-fixing developed silver in a color light-sensitive material that employs a conventional naphtholic cyan coupler, a serious problem occurs in that the cyan dye is reduced by a large amount of ferrous ions to produce a faded image.

SUMMARY OF THE INVENTION

An object, therefore, of the present invention is to provide a silver halide color photographic material that achieves a higher degree of sharpness without causing the fading of a cyan dye image during a bleaching or bleach-fixing step and which yet succeeds in ensuring improved stability in varying conditions of color development as well as improved storage stability.

As a result of the concerted efforts made to attain this object, the present inventors have found that this can be achieved by a silver halide color photographic material having red-, green- and blue-sensitive silver halide emulsions on a support, wherein the total thickness of the hydrophilic colloid layers is not more than 18 μm on a dry basis and at least one silver halide emulsion layer contains a cyan dye forming coupler represented by the following general formula (I):

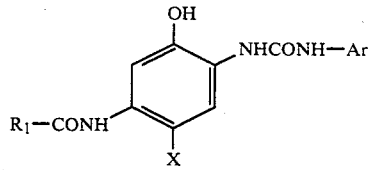

(I)

where $R_1$ is an optionally substituted alkyl, aryl or heterocyclic group; Ar is an optionally substituted aryl group; and X is a group that may be eliminated upon coupling reaction with the oxidized product of a color developing agent.

DETAILED DESCRIPTION OF THE INVENTION

In formula (I), $R_1$ signifies an optionally substituted alkyl, aryl or heterocyclic group.

Preferable examples of $R_1$ are alkyl, aryl and heterocyclic groups having 1–30 carbon atoms and include: straight-chained or branched alkyl groups, cycloalkyls, 5- or 6-membered heterocyclic groups, and groups represented by the following general formula (II):

(II)

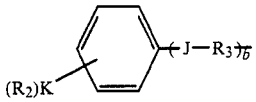

where J is an oxygen or sulfur atom; K is an integer of 0–4; b is 0 or 1; when K is 2 or more, $R_2$ may be the same or different; $R_3$ is a straight-chained or branched alkyl group having 1–20 carbon atoms; $R_2$ is a monovalent group such as a hydrogen atom, a halogen atom (preferably Cl or Br), an alkyl group (preferably a straight-chained or branched alkyl group having 1–20 carbon atoms), an aryl group, a heterocyclic group (preferably a nitrogenous heterocyclic group), an alkoxy group (preferably a straight-chained or branched alkyloxy group having 1–20 carbon atoms), an aryloxy group, a hydroxy group, an acyloxy group (preferably an alkylcarbonyloxy or arylcarbonyloxy group), a carboxy group, an alkoxycarbonyl group (preferably a straight-chained or branched alkyloxycarbonyl group having 1–20 carbon atoms), an aryloxycarbonyl group (preferably phenoxycarbonyl), an alkylthio group (preferably having 1–20 carbon atoms), an acyl group (preferably a straight-chained or branched alkylcarbonyl group having 1–20 carbon atoms), an acylamino group (preferably a straight-chained or branched alkylcarboamide having 1–20 carbon atoms or benzenecarboamide), a sulfonamido group (preferably a straight-chained or branched alkylsulfonamido group having 1–20 carbon atoms or benzenesulfonamido group), a carbamoyl group (preferably a straight-chained or branched alkylaminocarbonyl group having 1–20 carbon atoms or phenylaminocarbonyl group), and a sulfamoyl group (preferably a straight-chained or branched alkylaminosulfonyl group having 1–20 carbon atoms or a phenylaminosulfonyl group).

In formula (I), Ar signifies an optionally substituted aryl group, preferably a phenyl or naphthyl group, with phenyl being particularly preferred. Preferable examples of the substituent include: a halogen atom, a cyano group, a nitro group, a hydroxyl group, and optionally substituted alkyl, aryl, heterocyclic, alkylsulfonyl, arylsulfonyl, alkoxy, aryloxy, acyl, alkoxycarbonyl, aryloxycarbonyl, sulfonamido, acylamino, amino, sulfamoyl, carbamoyl and acyloxy groups. Among these substituents, a halogen atom, a cyano group, an alkyl group, an alkylsulfonyl group, an arylsulfonyl group, and a sulfonamido group are particularly preferred.

In formula (I), X signifies a group that can be eliminated upon coupling reaction with the oxidized product of a color developing agent. Illustrative examples of X include: a halogen atom, a thiocyano group, optionally substituted alkyloxy and aryloxy group, as well as optionally substituted heterocyclic oxy, alkylthio, arylthio, heterocyclic thio, acyloxy, sulfonamido, alkylsulfonyl, arylsulfonyl, acyl, heterocyclic, phosphonyloxy and arylazo groups. More specific examples of X are shown in: U.S. Pat. No. 3,476,563, Japanese Patent Application (OPI) No. 37425/1972 (the symbol OPI as used herein means an unexamined published Japanese patent application), Japanese Patent Publication No. 36894/1973, and Japanese Patent Application (OPI) Nos. 10135/1975, 117422/1975, 120334/1975, 130441/1975, 108841/1976, 18315/1977, 105226/1978, 14736/1979, 48237/1979, 32071/1980, 65957/1980, 1938/1981, 12643/1981 and 27147/1981.

Preferable examples of X include a fluorine atom, a chlorine atom, an alkyloxy group, an aryloxy group, a heterocyclic group, an alkylthio group, an arylthio group and a heterocyclic thio group, and particularly preferable examples are an alkyloxy group and an aryloxy group.

Examples of the compounds that may be used as the coupler of formula (I) are shown in, for example, Japanese Patent Application (OPI) Nos. 65134/1981, 204543/1982, 204544/1982, 204545/1982, 33249/1983, 33253/1983, 98731/1983, 118643/1983, 179838/1983, 187928/1983, 65844/1984, 71051/1984, 86048/1984, 105644/1984, 111643/1984, 111644/1984, 131939/1984, 165058/1984, 177558/1984, 180559/1984, 198455/1984, 35731/1985, 37557/1985, 49335/1985, 49336/1985, 50533/1985, 91355/1985, 107649/1985 and 107650/1985.

Several of the preferred examples of the cyan dye forming coupler suitable for use in the present invention are listed below and it should be understood that the scope of the present invention is by no means limited to these examples.

| Compound No. | $R_1$ | Ar | X |
|---|---|---|---|
| 1 | 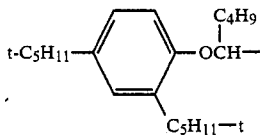 | 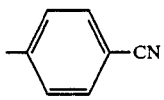 | 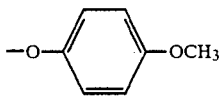 |
| 2 | 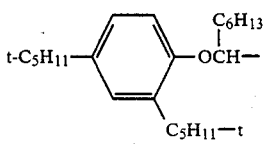 | 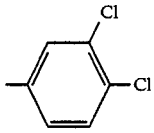 | 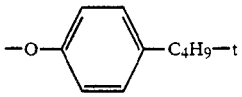 |

-continued
| Compound No. | $R_1$ | Ar | X |
|---|---|---|---|
| 3 | 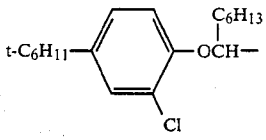 | 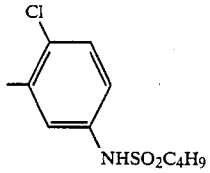 | —F |
| 4 | 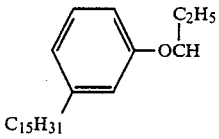 | 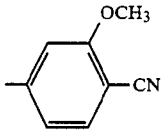 | 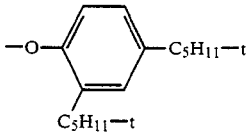 |
| 5 | 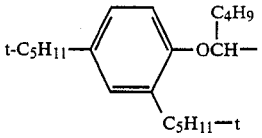 | 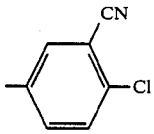 | 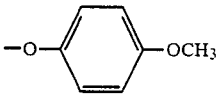 |
| 6 | 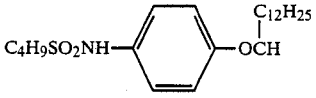 | 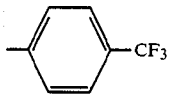 | $-OCH_2CONHC_4H_9-t$ |
| 7 | 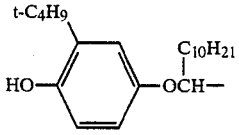 | 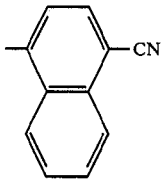 | 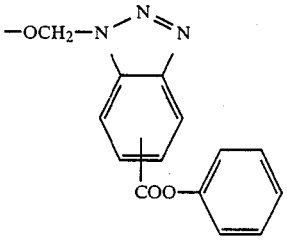 |
| 8 | 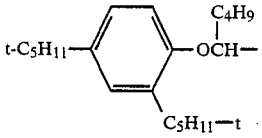 | 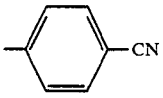 | 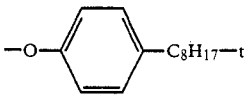 |
| 9 | 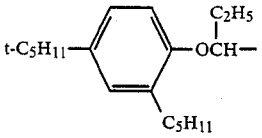 | 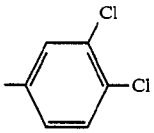 | $-O-CH_2CH_2SCH_2COOH$ |
| 10 | $CH_3-$ | 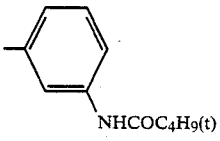 | $-OCH_2CONH(CH_2)_4-O-*$ 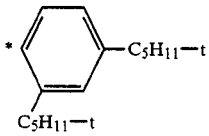 |
| 11 | 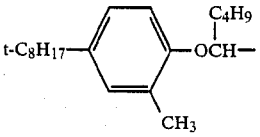 | 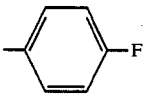 | —Cl |

-continued
| Compound No. | $R_1$ | Ar | X |
|---|---|---|---|
| 12 | 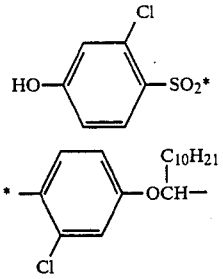 | 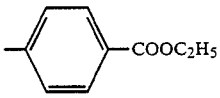 | 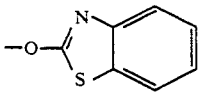 |
| 13 | 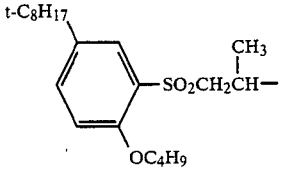 | 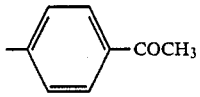 | 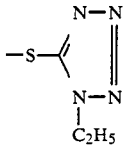 |
| 14 | 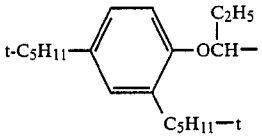 | 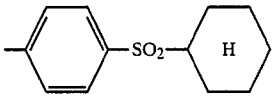 | $-O-(CH_2)_2-SO_2CH_3$ |
| 15 | 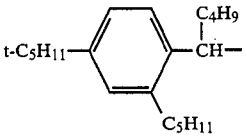 | 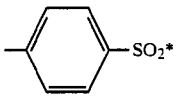 | $-Cl$ |
| | | 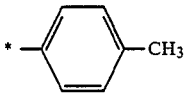 | |
| 16 | 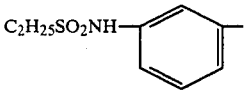 | 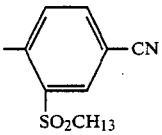 | $-OCH_3$ |
| 17 | 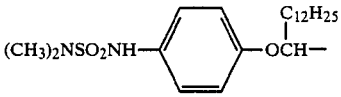 | 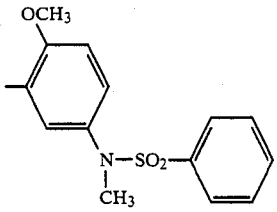 | 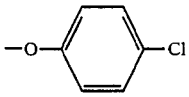 |
| 18 | 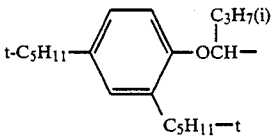 | 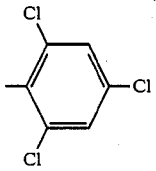 | $-SCN$ |
| 19 | $(CH_3)_3C-$ | 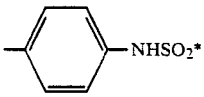 | 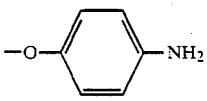 |

-continued
| Compound No. | $R_1$ | Ar | X |
|---|---|---|---|
| | | 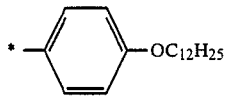 | |
| 20 | 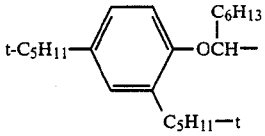 | 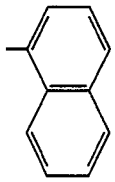 | $-NHSO_2CH_3$ |
| 21 | 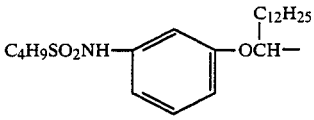 | 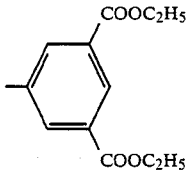 | 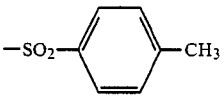 |
| 22 | 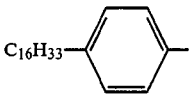 | 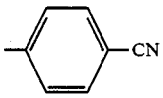 | 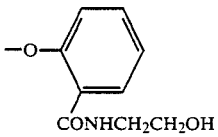 |
| 23 | $C_{15}H_{31}-$ | 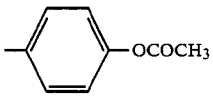 | $-Cl$ |
| 24 | 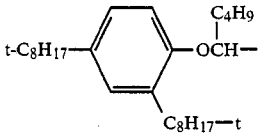 | 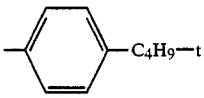 | 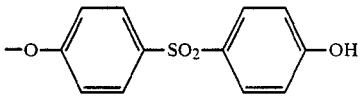 |
| 25 | 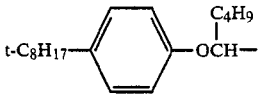 | 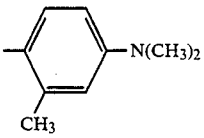 | 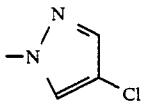 |
| 26 | 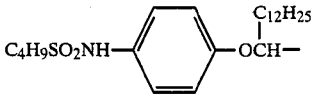 | 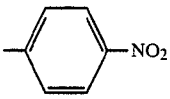 | 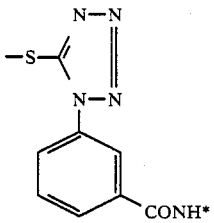 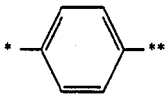 **NHNHCHO |

-continued
| Compound No. | $R_1$ | Ar | X |
|---|---|---|---|
| 27 | 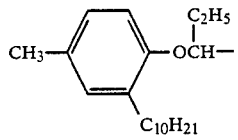 | 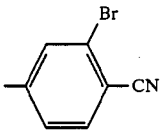 | 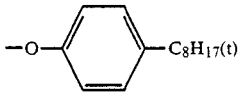 |
| 28 | 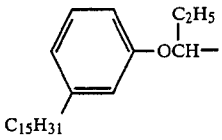 | 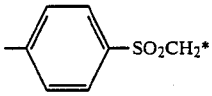 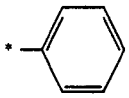 | $-OCH_2CH_2CH_2COOH$ |
| 29 | 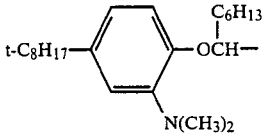 | 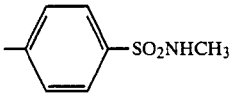 | $-F$ |
| 30 | 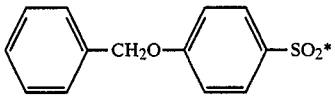 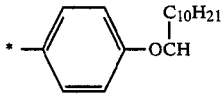 | 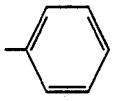 | 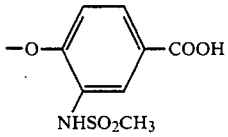 |
| 31 | 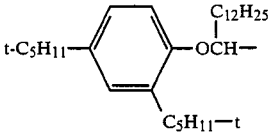 | 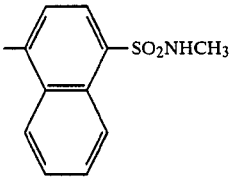 | 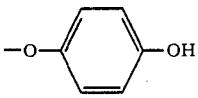 |
| 32 | 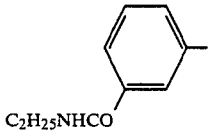 | 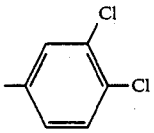 | 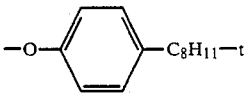 |
| 33 | 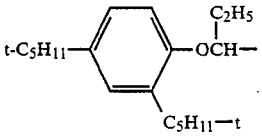 | 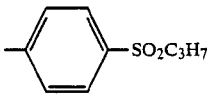 | 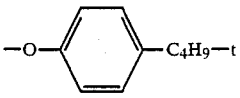 |
| 34 | 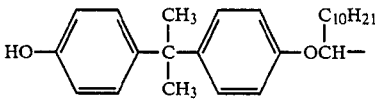 | 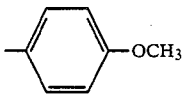 | 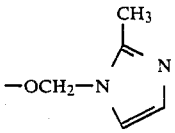 |

-continued
| Compound No. | $R_1$ | Ar | X |
|---|---|---|---|
| 35 | 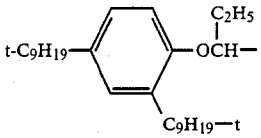 | 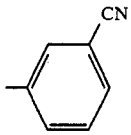 | $-OCH_2CH_2SO_2CH_2CH_2COOH$ |
| 36 | 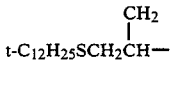 | 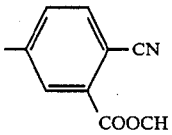 | 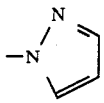 |
| 37 | 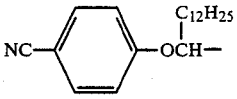 | 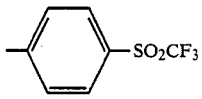 | 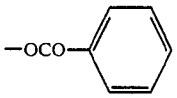 |
| 38 | 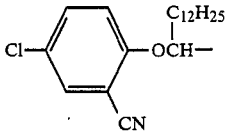 | 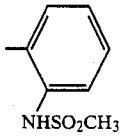 | 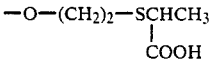 |
| 39 | 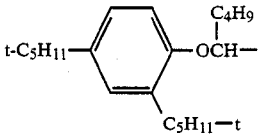 | 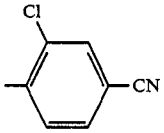 | 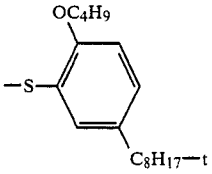 |
| 40 | 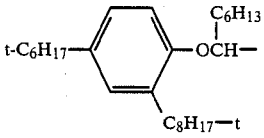 | 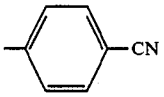 | $-Cl$ |
| 41 | 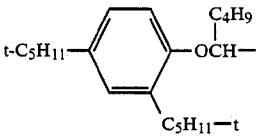 | 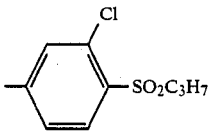 | 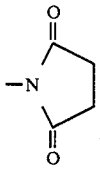 |
| 42 | 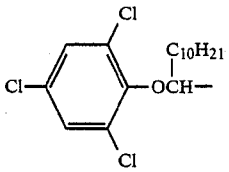 | 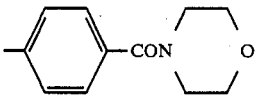 | 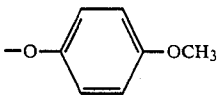 |
| 43 | 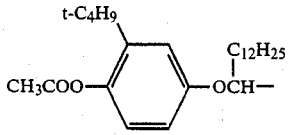 | 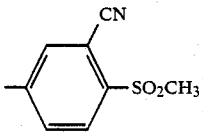 | 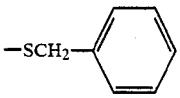 |

-continued
| Compound No. | $R_1$ | Ar | X |
|---|---|---|---|
| 44 | 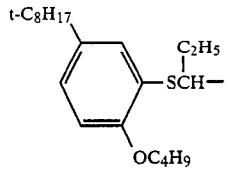 | 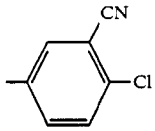 | $-OCHCH{=}CH_2$ |
| 45 | 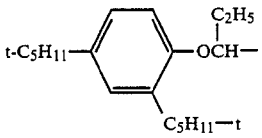 | 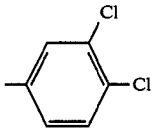 | $-Cl$ |
| 46 | 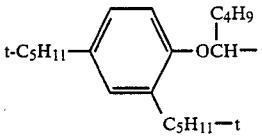 | 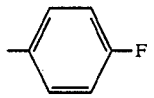 | 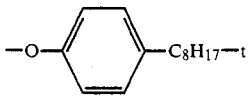 |
| 47 | 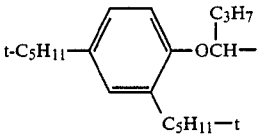 | 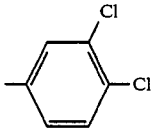 | 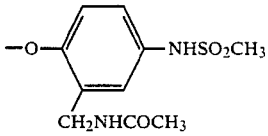 |
| 48 | 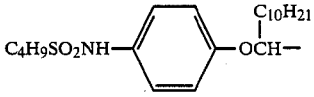 | 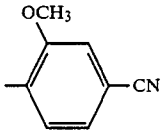 | 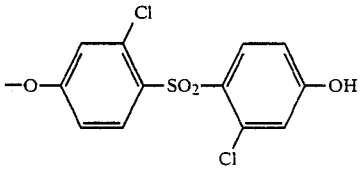 |
| 49 | 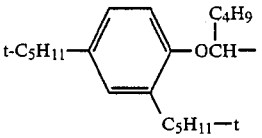 | 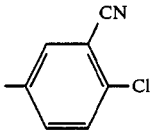 | 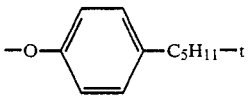 |
| 50 | 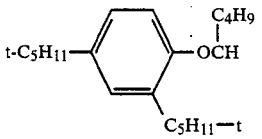 | 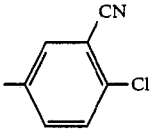 | $-Cl$ |
| 51 | 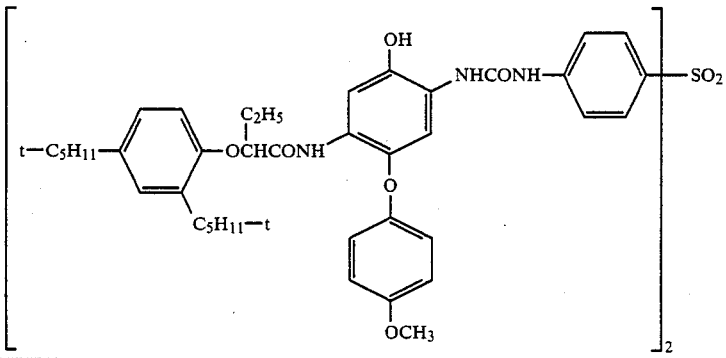 | | |
The above-described phenolic cyan coupler may be incorporated in a silver halide emulsion layer by any known method. For example, one or more of the couplers that are included within the scope of the present invention are dissolved in a mixture of a known high-boiling point solvent (e.g., dibutyl phthalate, tricresyl phosphate or dinonyl phenol) and a low-boiling point solvent (e.g., butyl acetate or propionic acid); the resulting solution is mixed with an aqueous gelatin solution containing a surfactant; the mixture is agitated in a high-speed rotary mixer, colloid mill or supersonic disperser so as to prepare a dispersion of the couplers; the resulting dispersion is directly added to an emulsion. Alternatively, the coupler dispersion is set, shredded, washed with water and added to an emulsion.

The phenolic cyan coupler of the present invention is incorporated in an emulsion in an amount which generally ranges from 0.005 to 5.0 moles, preferably from 0.01 to 2.0 moles, per mole of silver halide. The phenolic cyan couplers of the present invention may be employed either individually or in combination.

The term "total thickness of the hydrophilic colloid layers on a dry basis" as used in the present invention is measured under observation of a dry sample of photographic material in cross section with a scanning electron microscope. The lower limit of the total thickness of the hydrophilic colloid layers on the side where the emulsion layers are disposed (said total thickness is hereinafter referred to as the coating thickness on the emulsion side) is determined by the volume assumed by the components present such as the silver halide emulsion, oils (e.g., couplers, additives, and binders (e.g., gelatin), and a preferable coating weight on the emulsion side ranges from 5 to 18 μm, with the range of 10–16 μm being more preferable. The thickness as measured from the outermost surface of the emulsion side to the bottom of the emulsion layer which is situated the closest to the support is preferably not more than 14 μm, and the thickness as measured to the bottom of an emulsion layer that has a different color sensitivity than the innermost emulsion layer and which is situated the second closest to the support is preferably not more than 10 μm.

It suffices for the silver halide emulsion layer unit in the photographic material of the present invention to contain at least one each of red-, green- and blue-sensitive layers on a support. The arrangement of these layers may comprise, in order from the support side, a red-sensitive layer, a green-sensitive layer and a blue-sensitive layer. While other layer arrangements are possible, the above-specified arrangement is preferable. Each of the light-sensitive layers is composed of at least one, preferably at least two, sublayers.

The light-sensitive material of the present invention may incorporate a plurality of adjacent silver halide emulsion layers that are sensitive to substantially the same color but which have different values of sensitivity. One example of this embodiment is a photographic material of the normal layer arrangement, wherein red-, green- and blue-sensitive silver halide emulsion layers, each consisting of a high-sensitivity and a low-sensitivity sublayer, and disposed, adjacent to one another, on a support. The light-sensitive material of the present invention may alternatively be in the form of a dual-layered unit (i.e., the reverse layer arrangement) wherein a support is coated with a group of low-sensitivity emulsion layers which comprises, in order from the support side, red-, green- and blue-sensitive layers, and said group of low-sensitivity layers being coated with a group of high-sensitivity emulsion layers which comprises, in order from the support side, red-, green- and blue-sensitive layers. Part or all of the silver halide emulsion layers having different color sensitivities or those which have the same color sensitivity but which have different values of sensitivity may be interposed by intermediate layers that are formed of non-light-sensitive hydrophilic colloid layers. A protective non-light-sensitive hydrophilic colloid layer may be provided as a topcoat.

An object of the present invention, that is, a greater stability in varying conditions of color development, is effectively attained by incorporating a fine particulate, non-light-sensitive silver halide in at least one intermediate layer. It is particularly preferable to incorporate a fine particulate, non-light-sensitive silver halide in the non-light-sensitive hydrophilic colloid layer which is situated farthest from the support.

The term "fine particulate, non-light-sensitive silver halide" as used herein means those silver halide grains which have not been prefogged, are not exposed during the imagewise exposure that is effected to produce dye image, and which are not substantially developed in subsequent development. The fine particulate silver halide defined above has a silver bromide content of 0–100 mol% and may employ a variety of compositions so long as it satisfies this requirement for silver bromide content.

The fine particulate, non-light-sensitive silver halide may optionally contain silver chloride and/or silver iodide. The fine particulate, non-light-sensitive silver halide has an average grain size which preferably ranges from 0.01 to 0.3 μm, more preferably from 0.02 to 0.2 μm. The average size of silver halide grains means the average of the diameters of equivalent circles corresponding to the projected areas of individual silver halide grains, and may be measured by the method described on pages 277 and 278 of "Shashinkogaku no Kiso—Ginen Shashin Hen (Fundamentals of Photographic Engineering—Silver salt photography)", published by The Society of Photographic Science and Technology of Japan on Jan. 30, 1979.

The fine particulate silver halide may be prepared by a method which is the same or generally the same as what is employed to prepare ordinary light-sensitive silver halide emulsions. In this case, the surface of the silver halide grains need not be sensitized chemically or spectrally. It is, however, preferable that before being added to a coating fluid the fine silver halide grains are mixed with a known stabilizer selected from among, for example, triazole compounds, azaindene compounds, benzothiazolium compounds, mercapto compounds and zinc compounds.

If the silver halide color photographic material of the present invention contains two or more non-sensitive hydrophilic colloid layers, it suffices that at least one of them incorporates the fine particulate silver halide. The amount in which the fine particulate silver halide is incorporated in the non-sensitive hydrophilic colloid layer depends on several factors such as the halide composition of the fine particulate silver halide, its grain size the concentration of bromide ions in a developing solution, and the type of light-sensitive emulsion layers used, and generally ranges from 0.01 to 5 g/m$^2$, preferably from 0.1 to 1.0 g/m$^2$, in terms of silver. If the fine particulate silver halide is incorporated in two or more non-sensitive hydrophilic colloid layers, it suffices that the total amount of the fine particulate silver halide present is within the range of 0.01–5 g/m$^2$. It is not necessary to incorporate equal amounts of the fine particulate silver halide in each colloid layer. If the fine particulate silver halide is present in an amount of less than 0.1 mg/dm$^2$, the desired acceleration of development is not attainable. If the amount of fine particulate silver halide present exceed 50 mg/dm$^2$, the photographic performance of the resulting light-sensitive material is impaired as manifested by a significant drop in sensitivity or an increase in fog density.

The silver halide used in the present invention may have any composition and silver bromide, silver iodobromide and silver chloroiodobromide are particularly preferable.

During the formation and/or growth of grains, metal ions in the form of at least one compound selected from the group consisting of cadmium salts, zinc salts, lead salts, thallium salts, iridium salts (including complex salts), rhodium salts (including complex salts) and iron salts (including complex salts) may be added to silver halide grains so that these metal elements are incorporated in the bulk and/or surface of the grains. Alternatively, the silver halide grains may be exposed to a suitable reducing atmosphere so as to impart sensitizing centers in the bulk and/or surface of the grains.

The silver halide emulsion may be freed of any unwanted soluble salts after completion of silver halide grains. Such soluble salts may of course remain unremoved from the silver halide emulsion.

The silver halide grains used in the present invention may have a uniform distribution of silver halide composition through-out the interior of the grains. Alternatively, they may be core/shell grains having different silver halide compositions as between the interior and surface of the grains.

The silver halide grains may be of the surface image type (in which a latent image forms predominantly on the surface) or of the internal image type (in which a latent image is formed predominantly within the grains).

The silver halide grains may have regular crystallographic shapes such as cubic, octahedral and decahedral shapes; they may instead have anomalous shapes such as spherical and tabular shapes. These grains may have any proportions of {100} and {111} faces. The silver halide grains may assume a crystallographic shape which is a composite of the shapes listed above. Alternatively, grains of various crystallographic shapes may be mixed together. The size of the silver halide grains may range from 0.05 to 30 μm, preferably from 0.1 to 20 μm.

The silver halide emulsion used in the present invention may be a polydispersed emulsion having a broad grain size distribution. Alternatively, one or more monodispersed emulsions having a narrow size distribution may be employed. The monodispersed emulsion is such that the standard deviation of its particle size distribution divided by the average size is not more than 0.20. The particle size is expressed by the diameter of a spherical grain or by the diameter of an equivalent circle for the projected image of a non-spherical grain. A polydispersed emulsion may be used in combination with a monodispersed emulsion.

The silver halide emulsion may be chemically sensitized by routine methods. It may be sensitized spectrally for a desired wavelength range with the aid of various dyes that are knwon to be usable as sensitizing dyes in the art.

With a view to preventing the occurrence of fogging and to ensuring stable photographic performance during the manufacture, storage or photographic processing of a light-sensitive material, a suitable compound that is known as an antifoggant or stabilizer in the art may be added to the silver halide emulsion during or immediately after the completion of chemical ripening and/or in the period after completion of chemical ripening and before the application of a coating of the silver halide emulsion.

Gelatin is advantageously used as a binder or protective colloid) for the silver halide emulsion. Hydrophilic colloids may also be used and they include gelatin derivatives, graft polymers of gelatin and other high-molecular weight compounds, other proteins, sugar derivatives, cellulose derivatives, and synthetic hydrophilic high-molecular weight materials in the form of homo- or copolymers.

The photographic emulsion layers and other hydrophilic colloid layers in a light-sensitive material that employ the silver halide silver emulsion of the present invention may be hardened with one or more hardening agents which crosslink the molecule of the binder (or protective colloid) to provide a stronger film. The hardening agent may be added in such an amount that the light-sensitive material is hardened to an extent which does not require any additional hardening agent to be incorporated in the processing fluid. It is of course possible to add a hardening agent in the processing fluid, if desired.

A plasticizer may be added for the purpose of enhancing the flexibility of the silver halide emulsion layers and/or other hydrophilic colloid layers in the light-sensitive material.

The photographic emulsion layers and other hydrophilic colloid layers in the light-sensitive material may incorporate dispersions (latices) of synthetic polymers which are insoluble or slightly soluble in water for providing improved dimensional stability and for attaining other purposes.

The light-sensitive material contains in the emulsion layers various dye forming couplers which are capable of forming dyes upon coupling reaction with the oxidized products of aromatic primary amino developing agents (e.g., p-phenylenediamine derivatives and aminophenolic derivatives) during color development.

The dye forming couplers that can be used in the present invention include colored couplers which are capable of achieving color correction, as well as compounds that couple with the oxidized products of developing agents to release photographically useful fragments such as development restrainers, development accelerators, bleaching accelerators, developing agents, silver halide solvents, toning agents, hardening agents, foggants, antifoggants, chemical sensitizers, spectral sensitizers and desensitizers. Also usable are DIR compounds which release development restrainers as a function of the progress of development so as to improve the image sharpness and to decrease its graininess.

The oxidized product of a developing agent or an electron transfer agent may migrate between emulsion layers in the light-sensitive material (i.e., between layers having the same color sensitivity and/or betwen layers having different color sensitivities) so as to cause color contamination, degrade image sharpness or provide increased graininess. In order to avoid these problems, an agent that is capable of preventing color fogging may be employed.

The light-sensitive material of the present invention may contain an image stabilizer which serves to prevent the degradation of dye images.

The hydrophilic colloid layers such as protective and intermediate layers in the light-sensitive material may contain uv absorbers in order to prevent fogging from occurring on account of the discharging of electricity that has been produced by friction or other causes or to prevent image degradation due to uv radiation. A formaldehyde scavenger may also be incorporated for the purpose of preventing the magenta dye forming coupler from being deteriorated by formaldehyde during the storage of the light-sensitive material.

Dyes, uv absorbers and any other necessary additives may be mordanted when they are incorporated in hydrophilic colloid layers in the light-sensitive material. Useful mordants are cationic polymers.

The silver halide emulsion layers and/or other hydrophilic colloid layers in the light-sensitive material may contain bleaching accelerators or compounds that alter its developability, such as development accelerators and development retarders.

With a view to providing higher sensitivity, better contract or accelerated development, the emulsion layers in the photographic material of the present invention may contain such compounds as polyalkylene oxides, derivatives thereof (e.g., ether, ester or amine derivatives), thioether compounds, thiomorpholines, quaternary ammonium compounds, urethane derivatives, urea derivatives, and imidazole derivatives.

The light-sensitive material may also contain brighteners for the purpose of highlighting the white background, as well as rendering any staining of the white background less noticeable.

The light-sensitive material may have auxiliary layers such as a filter layer, an anti-halation layer, and an anti-irradiation layer. These auxiliary layers and/or emulsion layers may optionally contain dyes that are released from the light-sensitive material during development or which can be bleached in subsequent bleaching.

Matting agents may be incorporated in the silver halide emulsion layers and/or other hydrophilic colloid layers in the light-sensitive material for attaining various purposes such as reducing the gloss of the material, enhancing its adaptability for writing with a pencil or other writing devices, and preventing it from sticking to another light-sensitive material.

The light-sensitive material may contain a lubricant which serves to reduce the sliding friction. The material may also contain an antistat for preventing static buildup.

The photographic emulsion layers and/or other hydrophilic colloid layers in the light-sensitive material may contain a variety of surfactants for achieving various purposes such as improving the coating properties of these layers, preventing static buildup, improving the lubricity of the light-sensitive material, facilitating the dispersion of the necessary components and additives, preventing sticking, and improving the photographic characteristics of the material (e.g., accelerated development, hardenability and sensitization).

The support of the light-sensitive material of the present invention may be selected from among known supports which include: flexible reflective supports such as paper laminated with α-olefin polymers (e.g., polyethylene, polypropylene and ethylene/butene copolymers) and synthetic paper; films formed of semisynthetic or synthetic high-molecular weight materials such as cellulose acetate, cellulose nitrate, polystyrene, poly(vinyl chloride), polyethylene terephthalate, polycarbonates and polyamides; flexible supports having a reflective layer formed on these films; glass; metals; and ceramics.

Coating operations for preparing a light-sensitive material may start immediately after the support is surface-treated by such methods as corona discharge, exposure to uv radiation and flame treatment. If necessary, the so treated support may be coated with one or more subbing layers in order to improve the support surface with respect to such properties as antiblocking property, antistatic property, dimensional stability, wear resistance, hardness, antihalation property, and frictional properties.

In order to provide better coating properties, a thickening agent may be added to the coating fluid. Additives such as hardening agents are so reactive that they will gel before the coating operation starts if they are preliminarily added to the coating fluid. Additives of this type are preferably mixed with other components immediately before the coating operation by employing a suitable device such as a static mixer.

Particularly useful coating methods are extrusion coating and curtain coating, both of which are capable of simultaneous coating of multiple layers. Bucket coating may be employed if the specific object permits. Coating speeds may be selected such that they suit a specific case.

In order to obtain a dye image, the light-sensitive material of the present invention is processed by known color photographic processing techniques after exposure. Color processing consists of the steps of color development, bleaching, fixing and washing and, optionally, stabilizing. Bleaching and fixing steps may be replaced by a bleach-fixing step that is accomplished with a monobath bleach-fixing (blix) solution. If desired, a monobath processing step may be employed with a monobath development-bleach-fixing solution which is capable of achieving color development, bleaching and fixing in a single bath.

The following examples are provided for the purpose of further illustrating the present invention but are in no way intended to limit the scope of the invention. Unless otherwise noted, the amounts of compounds in each of the silver halide photographic materials prepared in the following examples are calculated for square meter. The amounts of silver halide and colloidal silver are expressed in terms of silver.

EXAMPLE 1

A sample of multilayered color photographic element was prepared by coating a triacetyl cellulose film base with twelve layers having the compositions shown below, wherein the layer arrangement is indicated in order from the support side. The prepared sample is designated sample No. 1 (comparison).

First layer:
anti-halation layer (HC-1)
Gelatin layer containing black colloidal silver (thickness, 1.5 μm)
Second layer:
intermediate layer (I.L.)
Gelatin layer containing 2,5-di-t-octylhydroquinone (thickness, 1.0 μm)
Third layer:
low-sensitivity, red-sensitive silver halide emulsion layer (RL-1)
Components:

monodispersed emulsion (Em-I) with an average grain size ($\bar{r}$) of 0.30 μm which was formed of AgBrI with 6 mol% AgI (silver deposit, 1.8 g/m$^2$);
sensitizing dye I ($6\times10^{-5}$ moles per mole of silver);
sensitizing dye II ($1.0\times10^{-5}$ moles per mole of silver);
cyan coupler (C-1) (0.06 moles per mole of silver); colored coupler (CC-1) (0.003 moles per mole of silver);
DIR compound (D-1) (0.0015 moles per mole of silver);
DIR compound (D-2) (0.002 moles per mole of silver);
Thickness: 2.7 μm
Fourth layer:
high-sensitivity, red-sensitive silver halide emulsion layer (RH-1)
Components:
monodispersed emulsion (Em-II) with an average grain size ($\bar{r}$) of 0.5 μm which was formed of AgBrI with 7.0 mol% AgI (silver deposit, 1.3 g/m$^2$);
sensitizing dye I ($3\times10^{31\ 5}$ moles per mole of silver);
sensitizing dye II ($1.0\times10^{-5}$ moles per mole of silver);
cyan coupler (C-1) (0.02 moles per mole of silver);
colored coupler (CC-1) (0.0015 moles per mole of silver);
DIR compound (D-2) (0.001 mole per mole of silver);
Thickness: 1.3 μm
Fifth layer:
intermediate layer (I.L.)
Same as the second layer (thickness, 1.5 μm)
Sixth layer:
low-sensitivity, green-sensitive silver halide emulsion layer (GL-1)
Components:
Em-1 (silver deposit, 1.5 g/m$^2$);
sensitizing dye III ($2.5\times10^{31\ 5}$ moles per mole of silver);
sensitizing dye IV ($1.2\times10^{-5}$ moles per mole of silver)
magenta coupler (M-1) (0.050 moles per mole of silver);
colored magenta coupler (CM-1) (0.009 moles per mole of silver);
DIR compound (D-1) (0.0010 mole per mole of silver);
DIR compound (D-3) (0.0030 moles per mole of silver);
Thickness: 2.5 μm
Seventh layer:
high-sensitivity, green-sensitive silver halide emulsion layer (GH-1)
Components:
Em-II (silver deposit, 1.4 g/m$^2$);
sensitivity dye III ($1.5\times10^{-5}$ moles per mole of silver);
sensitizing dye IV ($1.0\times10^{-5}$ mole per mole of silver);
magenta coupler (M-1) (0.020 moles per mole of silver);
colored magenta coupler (CM-1) (0.002 moles per mole of silver);
DIR compound (D-3) (0.0010 mole per mole of silver);
Thickness: 2.0 μm
Eighth layer:
yellow filter layer (YC-1)
Gelatin layer containing yellow colloidal silver and an emulsified dispersion of 2,5-di-t-dioctylhydroquinone
Thickness: 1.5 μm
Ninth layer:
low-sensitivity, blue-sensitive silver halide emulsion layer (BL-1)
Components:
monodispersed emulsion (Em-III) with an average grain size of 0.48 μm which was formed of AgBrI with 6 mol% AgI (silver deposit, 0.9 g/m$^2$)
sensitizing dye V ($1.3\times10^{-5}$ moles per mole of silver)
yellow coupler (Y-1) (0.29 moles per mole of silver);
Thickness: 3.0 μm
Tenth layer:
high-sensitivity, blue-sensitive silver halide emulsion layer (BH-1)
Components:
monodispersed emulsion (Em-IV) with an average grain size of 0.8 μm which was formed of AgBrI with 15 mol% AgI (silver deposit, 0.5 g/m$^2$)
sensitizing dye V ($1.0\times10^{-5}$ mole per mole of silver);
yellow coupler (Y-1) (0.08 moles per mole of silver);
DIR compound (D-2) (0.0015 moles per mole of silver);
Thickness: 1.5 μm
Eleventh layer:
first protective layer (Pro-1) Gelatin layer containing uv absorbers, UV-1 and UV-2
Thickness: 1.0 μm
Twelfth layer:
second protective layer (Pro-2)
Gelatin layer containing polymethyl methacrylate particles (1.5 μm dia.) and formaldehyde scavenger (HS-1)
Thickness: 0.5 μm Gelatin hardening agent (H-1) and a surfactant were also incorporated in each of the 12 layers.

The compounds incorporated in the individual layers of sample No. 1 are shown more specifically below.

Sensitizing dye I: anhydro-5,5'-dichloro-9-ethyl-3,3'-di-(3-sulfopropyl)thiacarbocyanine hydroxide
Sensitizing dye II: anhydro-9-ethyl-3,3'-di-(3-sulfopropyl)-4,5,4',5'-dibenzothiacarbocyanine hydroxide
Sensitizing dye III: anhydro-5,5'-diphenyl-9-ethyl-3,3'-di-(3-sulfopropyl)oxacarbocyanine hydroxide
Sensitizing dye IV: anhydro-9-ethyl-3,3'-di-(3-sulfopropyl)-5,6,5',6'-dibenzoxacarbocyanine hydroxide
Sensitizing dye V: anhydro-3,3'-di-(3-sulfopropyl)-4,5-benzo-5' methoxythiacyanine

C-1

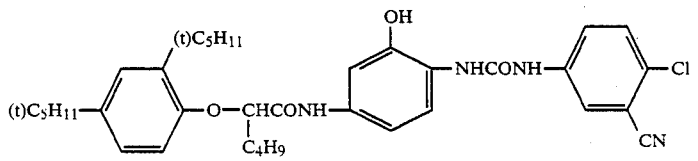

-continued
CC-1
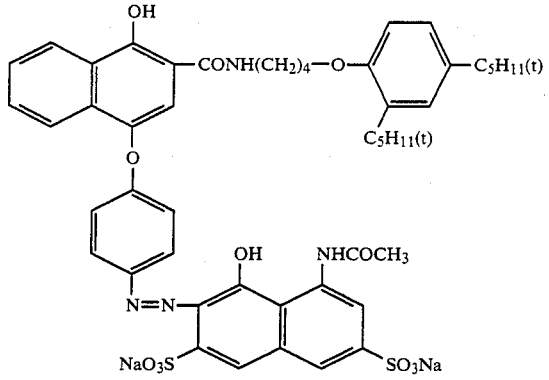
D-1
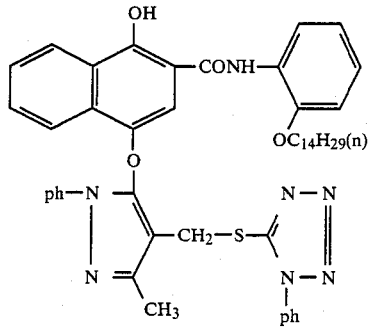
D-2
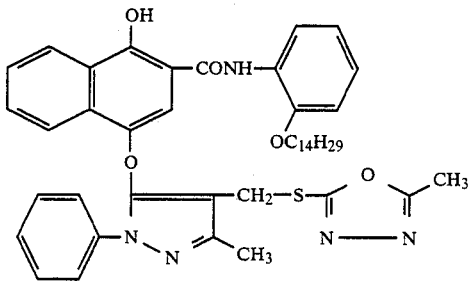
D-3
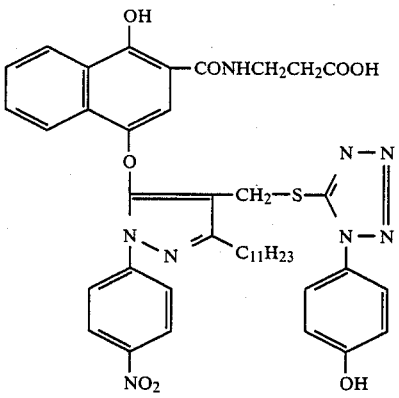
M-1
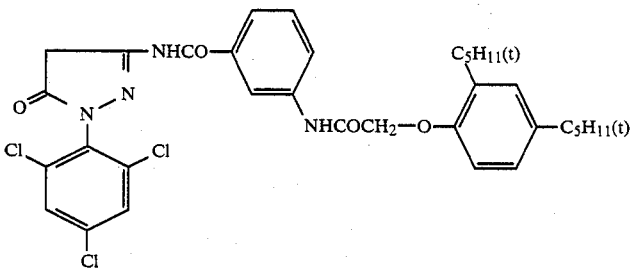

-continued

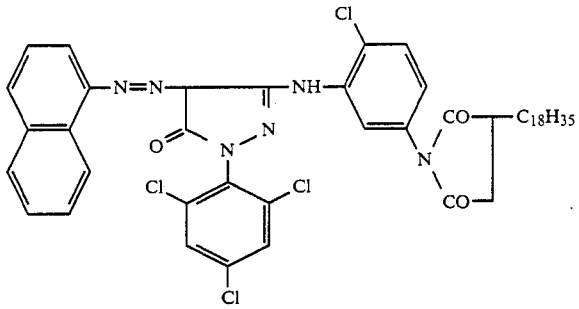

CM-1

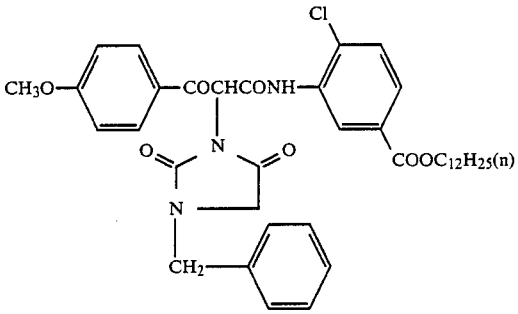

Y-1

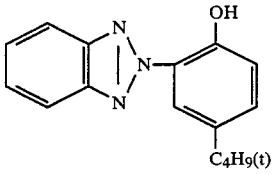

UV-1

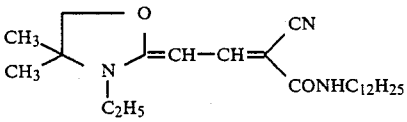

UV-2

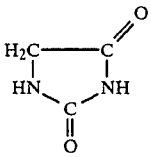

HS-1

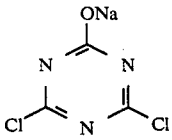

H-1

Additional samples (Nos. 2–23) were prepared and they were the same as sample No. 1 except for the modifications shown in Table 1. The coating thickness on a dry basis of each of the 3rd to 11th layers was adjusted by controlling the coating weight of gelatin.

TABLE 1

| sample No. | Coating thinkness on dry basis (μm) 3rd layer | 4th layer | 5th layer | 6th layer | 7th layer | 8th layer | 9th layer | 10th layer | 11th layer | Total thickness of 1st to 12th layers (μm) | Cyan coupler in 3rd layer (Illustrative compound No.) | Cyan coupler in 4th layer (Illustrative compound No.) | AgBrI (1 mol % AgI; average grain size, 0.07 μm) in 11th layer (g/m²) | Remarks |
|---|---|---|---|---|---|---|---|---|---|---|---|---|---|---|
| 2 | 2.7 | 1.3 | 1.5 | 2.5 | 2.0 | 1.5 | 3.0 | 1.5 | 1.0 | 20 | 0.03 mol of C-1 per mol of Ag | 0.01 mol of C-1 per mol of Ag | absent | A |
| 3 | 2.7 | 1.3 | 1.5 | 2.5 | 2.0 | 1.5 | 3.0 | 1.5 | 1.0 | 20 | 0.03 mol of No. 1 per mol of Ag instead of C-1 | 0.01 mol of No. 1 per mol of Ag instead of C-1 | absent | A |

TABLE 1-continued

| Sample No. | Coating thinkness on dry basis (μm) 3rd layer | 4th layer | 5th layer | 6th layer | 7th layer | 8th layer | 9th layer | 10th layer | 11th layer | Total thickness of 1st to 12th layers (μm) | Cyan coupler in 3rd layer (Illustrative compound No.) | Cyan coupler in 4th layer (Illustrative compound No.) | AgBrI (1 mol % AgI; average grain size, 0.07 μm) in 11th layer (g/m²) | Remarks |
|---|---|---|---|---|---|---|---|---|---|---|---|---|---|---|
| 4 | 2.7 | 1.3 | 1.5 | 2.5 | 2.0 | 1.5 | 3.0 | 1.5 | 1.0 | 20 | 0.03 mol of No. 2 per mol of Ag instead of C-1 | 0.01 mol of No. 2 per mol of Ag instead of C-1 | absent | A |
| 5 | 2.7 | 1.3 | 1.5 | 2.5 | 2.0 | 1.5 | 3.0 | 1.5 | 1.0 | 20 | 0.03 mol of No. 5 per mol of Ag instead of C-1 | 0.01 mol of No. 5 per mol of Ag instead of C-1 | absent | A |
| 6 | 2.7 | 1.3 | 1.5 | 2.5 | 2.0 | 1.5 | 3.0 | 1.5 | 1.0 | 20 | 0.03 mol of No. 9 per mol of Ag instead of C-1 | 0.01 mol of No. 9 per mol of Ag instead of C-1 | absent | A |
| 7 | 2.0 | 1.0 | 1.5 | 2.0 | 1.5 | 1.5 | 2.5 | 1.0 | 1.0 | 17μ | Same as sample No. 1 | Same as sample No. 1 | absent | A |
| 8 | 2.0 | 1.0 | 1.5 | 2.0 | 1.5 | 1.5 | 2.5 | 1.0 | 1.0 | 17μ | Same as sample No. 2 | Same as sample No. 2 | absent | A |
| 9 | 2.0 | 1.0 | 1.5 | 2.0 | 1.5 | 1.5 | 2.5 | 1.0 | 1.0 | 17μ | Same as sample No. 3 | Same as sample No. 3 | absent | B |
| 10 | 2.0 | 1.0 | 1.5 | 2.0 | 1.5 | 1.5 | 2.5 | 1.0 | 1.0 | 17μ | Same as sample No. 4 | Same as sample No. 4 | absent | B |
| 11 | 2.0 | 1.0 | 1.5 | 2.0 | 1.5 | 1.5 | 2.5 | 1.0 | 1.0 | 17μ | Same as sample No. 5 | Same as sample No. 5 | absent | B |
| 12 | 2.0 | 1.0 | 1.5 | 2.0 | 1.5 | 1.5 | 2.5 | 1.0 | 1.0 | 17μ | Same as sample No. 6 | Same as sample No. 6 | absent | B |
| 13 | 2.0 | 1.0 | 1.5 | 2.0 | 1.5 | 1.5 | 2.5 | 1.0 | 1.0 | 17μ | Same as sample No. 3 | Same as sample No. 3 | 0.5 | B |
| 14 | 1.5 | 0.7 | 1.5 | 1.5 | 1.2 | 1.5 | 2.0 | 1.0 | 1.0 | 14.9 | Same as sample No. 1 | Same as sample No. 1 | absent | A |
| 15 | 1.5 | 0.7 | 1.5 | 1.5 | 1.2 | 1.5 | 2.0 | 1.0 | 1.0 | 14.9 | Same as sample No. 2 | Same as sample No. 2 | absent | A |
| 16 | 1.5 | 0.7 | 1.5 | 1.5 | 1.2 | 1.5 | 2.0 | 1.0 | 1.0 | 14.9 | Same as sample No. 3 | Same as sample No. 3 | absent | B |
| 17 | 1.5 | 0.7 | 1.5 | 1.5 | 1.2 | 1.5 | 2.0 | 1.0 | 1.0 | 14.9 | Same as sample No. 3 | Same as sample No. 3 | 0.5 | B |
| 18 | 1.5 | 0.7 | 1.5 | 1.5 | 1.2 | 1.5 | 2.0 | 1.0 | 1.0 | 14.9 | Same as sample No. 4 | Same as sample No. 4 | absent | B |
| 19 | 1.5 | 0.7 | 1.5 | 1.5 | 1.2 | 1.5 | 2.0 | 1.0 | 1.0 | 14.9 | Same as sample No. 4 | Same as sample No. 4 | 0.5 | B |
| 20 | 1.5 | 0.7 | 1.5 | 1.5 | 1.2 | 1.5 | 2.0 | 1.0 | 1.0 | 14.9 | Same as sample No. 5 | Same as sample No. 5 | absent | B |
| 21 | 1.5 | 0.7 | 1.5 | 1.5 | 1.2 | 1.5 | 2.0 | 1.0 | 1.0 | 14.9 | Same as sample No. 5 | Same as sample No. 5 | 0.5 | B |
| 22 | 1.5 | 0.7 | 1.5 | 1.5 | 1.2 | 1.5 | 2.0 | 1.0 | 1.0 | 14.9 | Same as sample No. 6 | Same as sample No. 6 | absent | B |
| 23 | 1.5 | 0.7 | 1.5 | 1.5 | 1.2 | 1.5 | 2.0 | 1.0 | 1.0 | 14.9 | Same as sample No. 6 | Same as sample No. 6 | 0.5 | B |

Notes:
A, samples outside the scope of the invention;
B, samples of the present invention Each of the samples (Nos. 1–23) was illuminated with white light by wedge exposure or by contact exposure with a square-wave chart, and thereafter processed photographically by the following scheme.

Processing steps (38° C.)

Color development: 3 min and 15 sec
Bleaching: 6 min and 30 sec
Washing: 3 min and 15 sec
Fixing: 6 min and 30 sec
Washing: 3 min and 15 sec
Stabilizing: 1 min and 30 sec
Drying:
The following processing fluids were used.

Color developing solution

4-Amino-3-methyl-N-ethyl-N-(β-hydroxyethyl)-aniline sulfate: 4.75 g
Anhydrous sodium sulfite: 4.25 g
Hydroxylamine hemisulfate: 2.0 g
Anhydrous potassium carbonate: 37.5 g
Sodium bromide: 1.3 g
Nitrolotriazetic acid trisodium salt (monohydrate): 2.5 g
Potassium hydroxide: 1.0 g
Water: to make 1,000 ml Bleaching solution Ethylenediaminetetraacetic acid iron (II) ammonium salt: 100.0 g
Ethylenediaminetetraacetic acid diammonium salt: 10.0 g
Ammonium bromide: 150.0 g
Glacial acetic acid: 10.0 ml
Water: to make 1,000 ml
pH adjusted to 6.0 with aqueous ammonia Fixing solution Ammonium thiosulfate: 175.0 g
Anhydrous sodium sulfite: 8.5 g
Sodium metasulfite: 2.3 g
Water: to make 1,000 ml
pH adjusted to 6.0 with acetic acid Stabilizing solution uate the storage stability of each sample. The results are shown in Table 2 below.

TABLE 2

| Sample No. | Sensitometric characteristics S | Sensitometric characteristics Dm | MTF (%) | Resistance of cyan dye image to fading upon bleaching: S bleaching time (min) 6.5 | S bleaching time (min) 4.15 | S bleaching time (min) 2 | Dm bleaching time (min) .5 | Dm bleaching time (min) 4.15 | Dm bleaching time (min) 2 | Storage stability: S 22° C. 55% RH | S 44° C. 80% RH | Dm 23° C. 55% RH | Dm 44° C. 80% RH | 40° C. 80% coupler crystalization | 40° C. 80% bleeding |
|---|---|---|---|---|---|---|---|---|---|---|---|---|---|---|---|
| 1 | 100 | 1.80 | 100 | 100 | 74 | 55 | 1.80 | 1.51 | 1.20 | 97 | 89 | 1.75 | 1.60 | negative | negative |
| 2 | 73 | 1.54 | 97 | 73 | 55 | 38 | 1.54 | 1.28 | 0.94 | 73 | 69 | 1.53 | 1.46 | negative | negative |
| 3 | 104 | 1.85 | 105 | 104 | 75 | 56 | 1.85 | 1.53 | 1.23 | 100 | 95 | 1.83 | 1.80 | negative | negative |
| 4 | 105 | 1.87 | 107 | 105 | 76 | 57 | 1.87 | 1.53 | 1.24 | 100 | 94 | 1.84 | 1.79 | negative | negative |
| 5 | 103 | 1.86 | 106 | 103 | 75 | 56 | 1.86 | 1.52 | 1.24 | 100 | 96 | 1.83 | 1.80 | negative | negative |
| 6 | 100 | 1.83 | 101 | 100 | 74 | 55 | 1.83 | 1.52 | 1.23 | 99 | 93 | 1.81 | 1.77 | negative | negative |
| 7 | 105 | 1.90 | 120 | 105 | 81 | 63 | 1.90 | 1.60 | 1.29 | 100 | 41 | 1.80 | 0.81 | positive | positive |
| 8 | 183 | 1.62 | 123 | 83 | 65 | 55 | 1.62 | 1.30 | 0.98 | 80 | 53 | 1.60 | 1.18 | negative | negative |
| 9 | 128 | 2.10 | 135 | 128 | 90 | 79 | 2.10 | 1.87 | 1.75 | 126 | 115 | 2.05 | 1.90 | negative | negative |
| 10 | 125 | 2.15 | 130 | 125 | 95 | 80 | 2.15 | 1.90 | 1.82 | 122 | 107 | 2.12 | 1.97 | negative | negative |
| 11 | 124 | 2.18 | 137 | 124 | 98 | 83 | 2.18 | 1.95 | 1.85 | 124 | 116 | 2.16 | 2.03 | negative | negative |
| 12 | 120 | 2.08 | 128 | 120 | 88 | 77 | 2.08 | 1.77 | 1.70 | 118 | 107 | 2.05 | 1.84 | negative | negative |
| 13 | 129 | 2.10 | 135 | 128 | 92 | 81 | 2.10 | 1.89 | 1.82 | 127 | 117 | 2.07 | 1.95 | negative | negative |
| 14 | 108 | 1.95 | 125 | 108 | 91 | 70 | 1.95 | 1.75 | 1.30 | 104 | 28 | 1.92 | 0.49 | positive | positive |
| 15 | 85 | 1.75 | 126 | 85 | 73 | 67 | 1.75 | 1.38 | 1.19 | 83 | 22 | 1.77 | 0.40 | positive | positive |
| 16 | 131 | 2.20 | 150 | 131 | 129 | 90 | 2.20 | 2.05 | 1.98 | 130 | 109 | 2.19 | 2.00 | negative | negative |
| 17 | 135 | 2.28 | 154 | 135 | 130 | 94 | 2.28 | 2.19 | 2.08 | 134 | 113 | 2.28 | 2.07 | negative | negative |
| 18 | 135 | 2.30 | 160 | 135 | 129 | 92 | 2.30 | 2.20 | 2.11 | 134 | 114 | 2.25 | 2.13 | negative | negative |
| 19 | 137 | 2.45 | 163 | 137 | 134 | 103 | 2.45 | 2.38 | 2.29 | 135 | 119 | 2.43 | 2.36 | negative | negative |
| 20 | 130 | 2.33 | 158 | 130 | 127 | 93 | 2.33 | 2.17 | 2.03 | 128 | 115 | 2.28 | 2.21 | negative | negative |
| 21 | 133 | 2.48 | 161 | 133 | 130 | 97 | 2.48 | 2.37 | 2.30 | 131 | 121 | 2.43 | 2.35 | negative | negative |
| 22 | 130 | 2.15 | 145 | 130 | 124 | 85 | 2.15 | 2.00 | 1.83 | 128 | 105 | 2.03 | 1.95 | negative | negative |
| 23 | 130 | 2.20 | 148 | 131 | 126 | 89 | 2.20 | 2.12 | 2.03 | 129 | 110 | 2.15 | 2.06 | negative | negative |

Formaldehyde (37% aq. sol.): 1.5 ml

Konidax (Konishiroku Photo Industry Co., Ltd.): 7.5 ml

Water: to make 1,000 ml

Each of the processed samples was subjected to the evaluation of sensitometric characteristics and image sharpness for red light. In the evaluation of sensitometric characteristics, the samples that had been subjected to wedge exposure were used and the relative sensitivity (S) (with the value for sample No. 1 being taken as 100) and maximum color density (Dm) of each sample were measured.

Image sharpness was evaluated in terms of MTF (Modulation Transfer Function) which was determined by the following method: each of the samples that had been subjected to contact exposure with a square-wave chart was set in a Sakura densitometer, Model PDM-5, type AR (Konishiroku Photo Industry Co., Ltd.), where density measurements were conducted with a train of slits (300 μm×2 μm); and the resolving power of the sample was determined as the percentage of input modulation. Red light was used as the input light and the MTF was expressed in relative values at a spatial velocity of 30 cycles/mm, with the value for sample No. 1 being taken as 100.

In order to evaluate the resistance of cyan dye images against fading upon bleaching, the sensitometric characteristics for red light of sample Nos. 1–23 were determined with the period of bleaching being varied as 6 min and 30 sec, 4 min and 15 sec, and 2 min. Some of the test pieces of each sample were stored for 20 days under two different conditions, 40° C.×80% r.h. and 23° C.×55% r.h., before they were processed photographically as above. Thereafter, the processed samples were subjected to the evaluation of sensitometric characteristics and image sharpness and observed with an optical microscope to see whether coupler crystallizaton and bleeding had occurred in the light-sensitive material. The purpose of conducting this experiment was to eval- The data for sample Nos. 1 to 6 wherein the total thickness of the photographic layers on a dry basis was 20 μm which exceeded the upper limit specified by the present shows that cyan couplers that were within the scope of the present invention were not much different from the comparative coupler (C-1) in terms of the resistance of cyan dye image to fading upon bleaching and its storage stability. Sample Nos. 9–13 of the present invention wherein the total thickness of the photographic layers on a dry basis was 17 μm achieved significant improvements in image sharpness and resistance to fading and yet experienced no greater sensitometric deterioration than what occurred in the samples having a total coating thickness of 20 μm. In comparative sample No. 7 which also used a total coating thickness of 17 μm, coupler crystallization and bleeding occurred in the coating layers during storage to thereby cause substantial impairment of the sensitometric characteristics. Another comparative sample No. 8 which incorporated a cyan coupler in the same amount as in the samples of the present invention did not cause any coupler crystallization or bleeding but it was not capable of achieving a satisfactory color density and hence was not suitable for use as a color light-sensitive material.

In sample Nos. 16–23 of the present invention, the total coating thickness was further reduced to 14.9 μm; they were excellent color light-sensitive materials that achieved further improvements in image sharpness and resistance of cyan dye image to fading without experiencing any substantial deterioration of storage stability.

EXAMPLE 2

The stability of photographic materials (sample Nos. 1–3, 6–9 and 13–17 prepared in Example 1) in varying processing conditions was evaluated by determining their sensitometric characteristics after processing them as in Example 1 except that the composition of the color developing solution was altered as shown in Table 3 below.

TABLE 3

| Component (g/L) | Inactive developer | Standard developer | Active developer |
|---|---|---|---|
| A* | 4.05 | 4.75 | 5.70 |
| B** | 1.50 | 1.30 | 1.10 |
| C*** | 0.30 | 0.15 | 0 |

*A: 4-amino-3-methyl-N—ethyl-N—(β-hydroxyethyl)-aniline sulfate
**B: sodium bromide
***C: 4-hydroxy-6-methyl-1,3,3a,7-tetrazaindene The sensitometric characteristics of the processed samples are shown in Table 4, wherein the "relative sensitivity" is expressed as a relative value, with the value attained by processing in the standard developing solution being taken as 100.

When the total coating thickness was 20 μm, the stability in varying processing conditions was substantially constant irrespective of the type of coupler used, as is clear from comparison of sample Nos. 1 and 2 with sample Nos. 3 and 6. When the total coating thickness was decreased to 17 μm or 14.9 μm, sample Nos. 7 and 8 (17 μm) and sample Nos. 14 and 15 (14.9 μm), all of which used a comparative coupler, experienced considerable fluctuations in their sensitometric characteristics upon development under varying conditions. However, sample Nos. 9 and 13 (17 μm) and sample Nos. 16 and 17 (14.9 μm) of the present invention experienced only small fluctuations in their sensitometric characteristics in spite of their thin coating format. In particular, sample Nos. 13 and 17 each containing fine particulate silver iodobromide in the eleventh layer was much superior to the comparative samples.

TABLE 4

| Sample No. | Relative sensitivity | | |
|---|---|---|---|
| | Inactive developing solution | Standard developing solution | Active developing solution |
| 1 | 78 | 100 | 126 |
| 2 | 80 | 100 | 125 |
| 3 | 83 | 100 | 125 |
| 6 | 82 | 100 | 124 |
| 7 | 53 | 100 | 139 |
| 8 | 60 | 100 | 136 |
| 9 | 82 | 100 | 127 |
| 13 | 89 | 100 | 125 |
| 14 | 44 | 100 | 145 |
| 15 | 47 | 100 | 143 |
| 16 | 77 | 100 | 129 |
| 17 | 88 | 100 | 117 |

What is claimed is:

1. A silver halide color photographic material which has red-, green- and blue-sensitive silver halide emulsion layers with interlayers being interposed between said emulsion layers to form hydrophilic colloid layers on a support, wherein the total thickness of the hydrophilic colloid layers is not more than 18 μm on a dry basis and at least one silver halide emulsion layer contains a cyan dye-forming coupler represented by the following general formula (I):

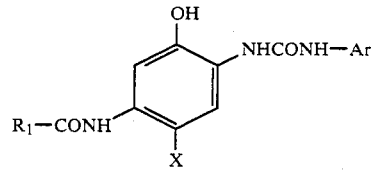

(I)

where $R_1$ is an optionally substituted alkyl, aryl or heterocyclic grpoup; Ar is an optionally substituted aryl group; and X is a group that may be eliminated upon coupling reaction with the oxidized product of a color developing agent.

2. A silver halide color photographic material according to claim 1, wherein the total thickness of the hydrophilic colloid layers is 5 to 18 μm on a dry basis.

3. A silver halide color photographic material according to claim 1, wherein the total thickness of the hydrophilic colloid layers is 10 to 16 μm on a dry basis.

4. A silver halide color photographic material according to claim 1, wherein said cyan dye-forming coupler is incorporated in said red-sensitive silver halide emulsion layer.

5. A silver halide color photographic material according to claim 1, wherein said cyan dye-forming coupler is incorporated in an amount ranging from 0.005 to 5.0 moles per mole of silver halide.

6. A silver halide color photographic material according to claim 1, wherein said cyan dye-forming coupler is incorporated in an amount ranging from 0.01 to 2.0 moles per mole of silver halide.

7. A silver halide color photographic material according to claim 1, wherein $R_1$ in said formula (I) represents a substituted or unsubstituted alkyl or aryl group.

8. A silver halide color photographic material according to claim 7, wherein said $R_1$ represents a substituted alkyl group.

9. A silver halide color photographic material according to claim 7, wherein said $R_1$ represents an alkyl group represented by the following formula (II):

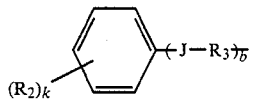

(II)

wherein J is an oxygen or sulfur atom; k is an integer of 0 to 4; b is 0 or 1; $R_2$ is a monovalent group; and $R_3$ is an alkyl group.

10. A silver halide color photographic material according to claim 1, wherein at least one of said hydrophilic colloid layers is a non-light-sensitive hydrophilic colloid layer containing a fine particulate, non-light-sensitive silver halide.

11. A silver halide color photographic material according to claim 10, wherein said non-light-sensitive hydrophilic colloid layer is positioned farthest from the support.

* * * * *